United States Patent [19]

Elward

[11] 4,105,152

[45] Aug. 8, 1978

[54] ASPARAGUS CONTAINER

[75] Inventor: John R. Elward, Novato, Calif.

[73] Assignee: Fibreboard Corporation, San Francisco, Calif.

[21] Appl. No.: 840,990

[22] Filed: Oct. 11, 1977

[51] Int. Cl.[2] ..... B65D 5/32

[52] U.S. Cl. ..... 229/23 BT; 229/6 A; 229/16 C; 229/34 R

[58] Field of Search ..... 229/6 A, 16 A, 16 C, 229/32, 34 R, DIG. 14, 23 BT

[56] References Cited

U.S. PATENT DOCUMENTS

| | | | |
|---|---|---|---|
| 1,198,473 | 9/1916 | Obenchain et al. | 229/16 C |
| 2,019,995 | 11/1935 | Rippen | 229/23 B |
| 2,041,949 | 5/1936 | Patterson | 229/6 A |
| 2,076,018 | 4/1937 | Ferguson | 229/6 A |
| 2,578,878 | 12/1951 | Buttery | 229/32 |
| 2,819,008 | 1/1958 | White et al. | 229/23 BT |
| 3,045,387 | 7/1962 | Simpson, Jr. | 229/6 A |
| 3,450,347 | 6/1969 | Lewis et al. | 229/32 |

FOREIGN PATENT DOCUMENTS

| | | | |
|---|---|---|---|
| 1,466,445 | 1/1967 | France | 229/6 A |
| 202,503 | 8/1923 | United Kingdom | 229/16 C |

*Primary Examiner*—William Price
*Assistant Examiner*—Bruce H. Bernstein
*Attorney, Agent, or Firm*—Phillips, Moore, Weissenberger, Lempio & Majestic

[57] ABSTRACT

A paperboard container comprises an opened top receptacle adapted to contain foodstuffs therein and a separate cover telescopically disposed on the receptacle. The receptacle comprises a bottom panel, a pair of laterally spaced end panels, a back panel and a front panel hingedly connected to the bottom panel. A pair of lock flaps are hingedly connected to opposite ends of the front panel to each engage within a slot defined on a forward edge of a respective end panel. A slit, formed on the end panel, defines a lock tab adapted to bend outwardly to receive the lock flap thereunder when the front panel is moved to its closed position. The receptacle is adapted to be loaded with foodstuffs, such as asparagus, upon opening of the front panel which is thereafter closed for reception of the cover on the receptacle.

9 Claims, 4 Drawing Figures

ASPARAGUS CONTAINER

BACKGROUND OF THE INVENTION

This invention relates to a paperboard container adapted to retain foodstuffs, such as asparagus, therein.

Containers of this type must be opened expeditiously to expose the receptacle thereof for loading and unloading purposes. A standard box-like container comprises a cover telescopically mounted on the receptacle whereby removal of the cover will facilitate top-loading of foodstuffs in the receptacle. Such loading not only prevents a close packing of the foodstuffs together, but also subjects them to damage. Furthermore, unloading of the foodstuffs via the opened top of the receptacle proves difficult with foodstuffs, such as asparagus spears, and also subjects them to further damage and resulting spoilage.

SUMMARY OF THIS INVENTION

An object of this invention is to overcome the above, briefly described problems by providing a container adapted for the expeditious and compact loading of foodstuffs, such as asparagus spears, therein.

The container comprises an opened top receptacle adapted to contain the foodstuffs therein and a separate cover telescopically disposed on the receptacle. The receptacle comprises a bottom panel, a pair of laterally spaced end panels, a back panel secured to each of the bottom and end panels and a front panel hingedly mounted on the container for pivotal movement between closed and opened positions thereon. Lock means are provided for normally locking the front panel to at least one of the end panels when the front panel is maintained in its closed position on the container. Upon opening of the front panel, the foodstuffs may be side-loaded in a compact manner within the receptacle. When the container is utilized for the containment of asparagus spears therein, the container preferably comprises a trapezoidal cross section to fully accommodate the tapered configuration of the asparagus spears.

BRIEF DESCRIPTION OF THE DRAWINGS

Other objects of this invention will become apparent from the following description and accompanying drawings wherein.

DETAILED DESCRIPTION

Figure 1:
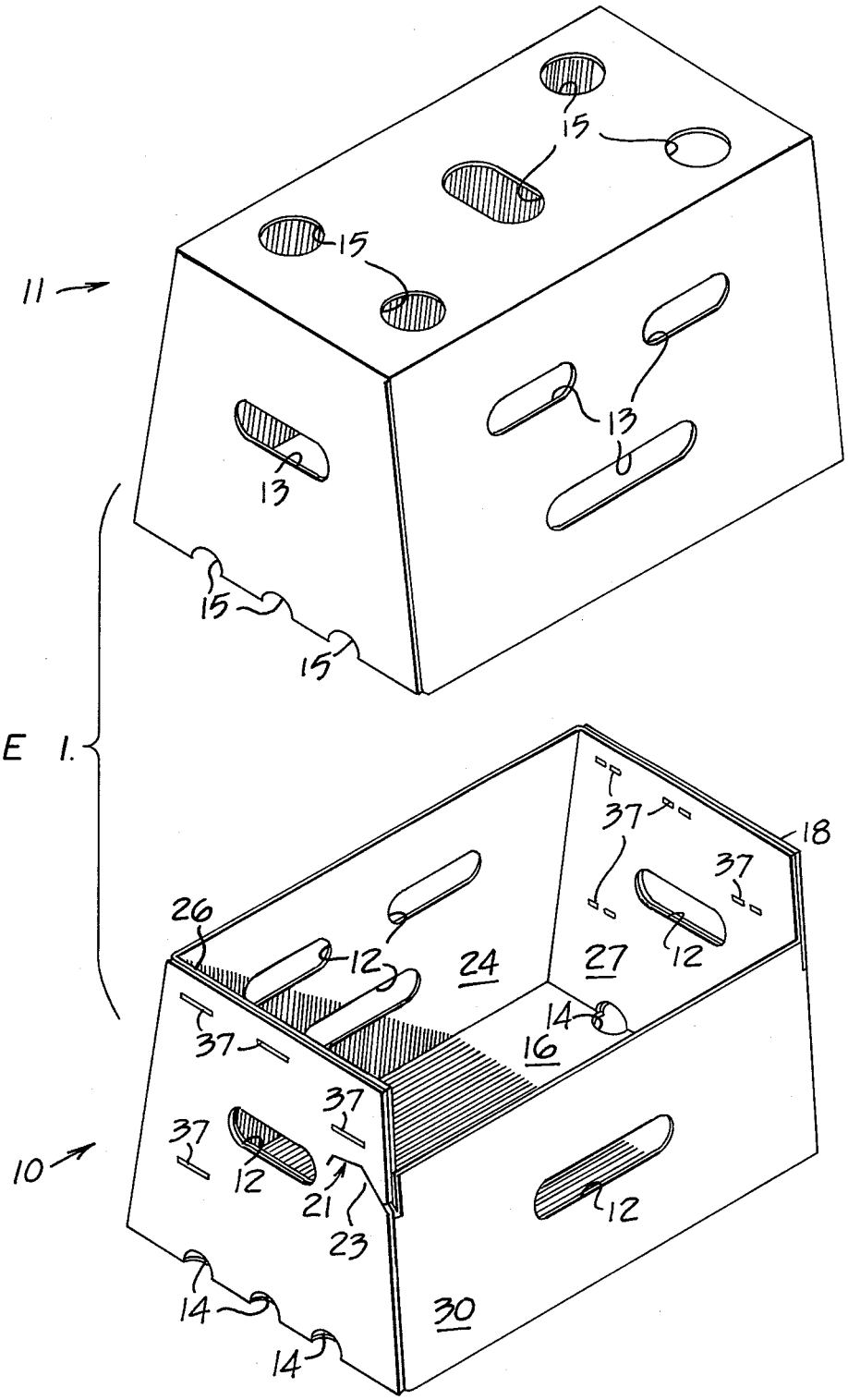
FIG. 1 is an exploded view of a container embodying this invention comprising a cover illustrated in its removed position from a receptacle thereof.

FIG. 1 illustrates a container comprising an opened top receptacle 10 adapted to retain foodstuffs therein and a separate cover 11 adapted to be telescopically disposed on the receptacle. The receptacle has a plurality of finger slots 12 formed through the integrated panels thereof which are adapted to align with corresponding slots 13 formed through the panels forming the cover to provide carrying means to facilitate lifting and transport of the container. In addition, a plurality of air vents or holes 14 and 15, formed through the panels of the receptacle and cover, respectively, cooperate with slots 12 and 13 to provide for the communication of ambient air within the container to keep the foodstuffs in a fresh condition.

Figure 2:
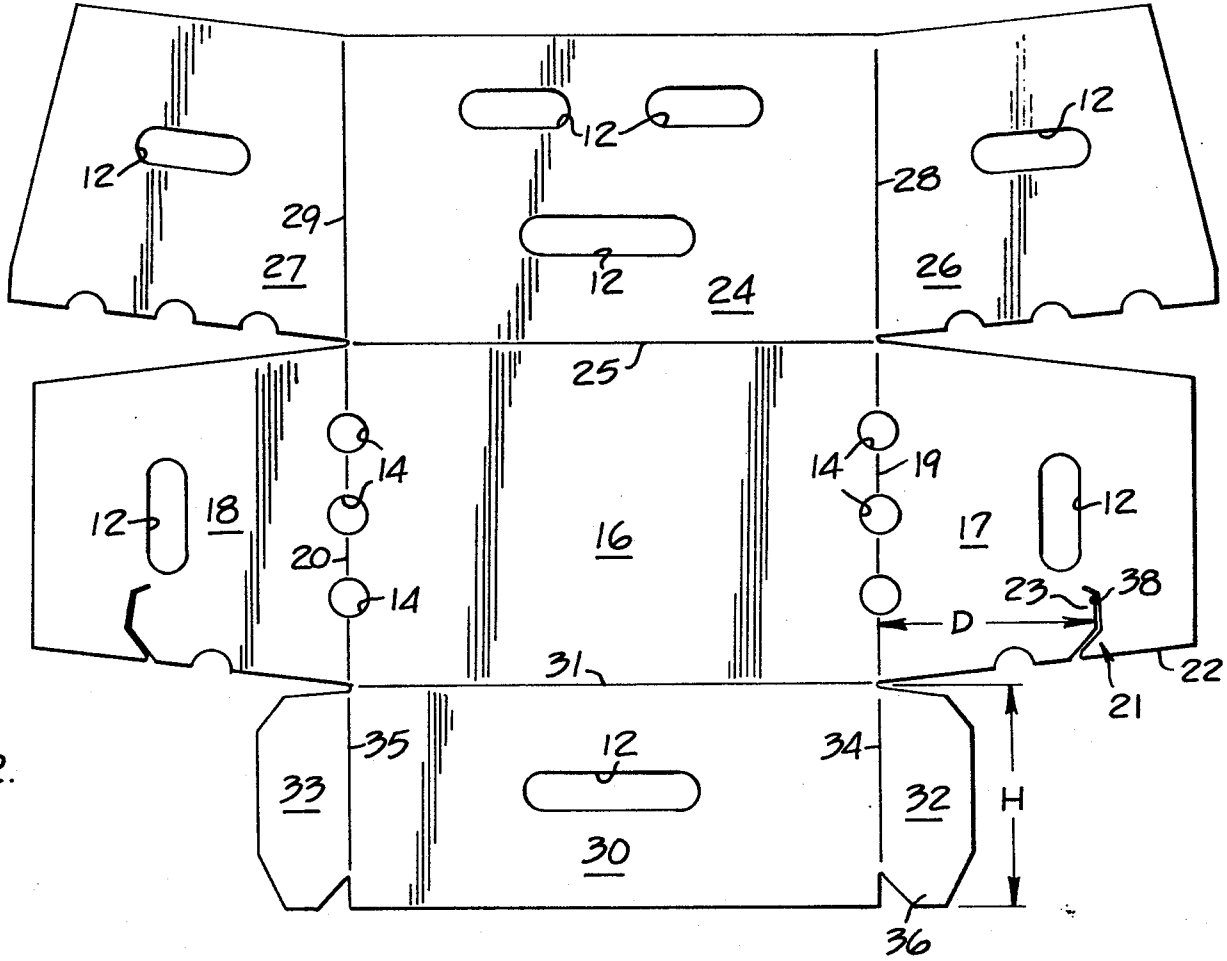
FIG. 2 is a top plan view of a one-piece blank utilized to form the receptacle.

FIG. 2, disclosing a flattened one-piece blank adapted to be ereceted into receptacle 10, comprises a rectangular bottom panel 16 having a pair of trapezoidal-shaped first end panels 17 and 18 hingedly connected to opposite end edges thereof by a pair of parallel scorelines 19 and 20, respectively. A slit or cut 21 is formed through each first end panel and is disposed at a distance $D_1$ from scoreline 19, for example, and intersects a forward edge 22 of the end panel. The cut defines a generally trapezoidal-shaped and flexible lock tab 23 for purposes hereinafter explained.

A rectangular back panel 24 is hingedly connected to a rearward edge of bottom panel 16 by a scoreline 25. Second end panels 26 and 27, each trapezoidal-shaped to conform with the shape of an adjacent first end panel 17 or 18, are hingedly connected to opposite end edges of the back panel by scorelines 28 and 29, respectively. A front panel 30 is hingedly connected to a forward edge of bottom panel 16 by a scoreline 31.

A pair of lock flaps 32 and 33 are hingedly connected to opposite end edges of the front panel by scorelines 34 and 35, respectively. As shown, each lock flap has a height H in the direction of scoreline 34 an coextensive therewith which is at least substantially the same as distance D, between scoreline 19 and cut 21. Each lock flap terminates at a generally trapezoidal-shaped flap portion 36 which substantially conforms to the configuration of cut 21.

Figure 4:
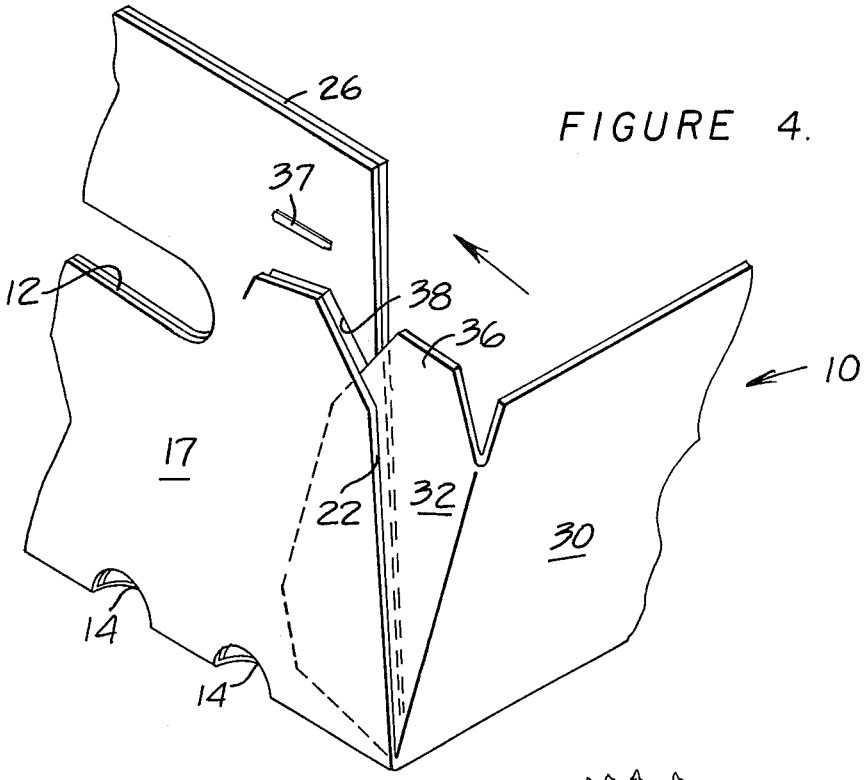
FIG. 4 is an enlarged view of a front corner of the receptacle, illustrating lock means employed to lock an openable front panel of the receptacle to an end panel thereof.
Figure 3:
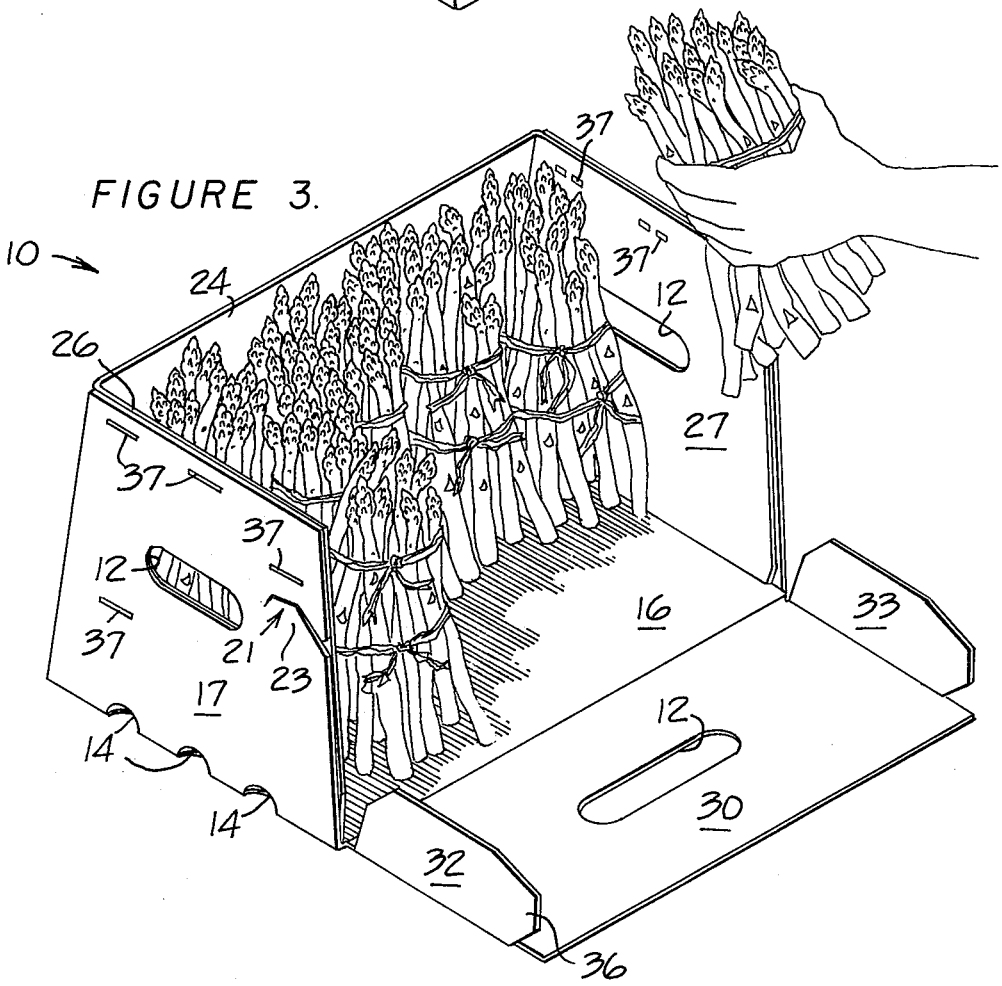
FIG. 3 is a front isometric view, illustrating the receptacle in its erected form and being loaded with bunches of asparagus spears.

FIGS. 1, 3 and 4 illustrate receptacle 10 in its erected condition whereby a plurality of staples 37 secure first end panels 17 and 18 to second end panels 26 and 27, respectively. A pair of double-walled composite end panels are thus formed at each end of the receptacle to substantially increase the structural integrity and stacking strength thereof. The one-piece blanks utilized to form receptacle 10 as well as cover 11 are preferably composed of a standard corrugated paperboard which exhibits very high strength characteristics.

FIG. 3 illustrates front panel 30 in its opened position whereby receptacle 10 may be loaded with tied bunches of asparagus spears. The trapezoidal-shaped configuration of the receptacle facilitates compact loading of the asparagus spears therein, i.e., the asparagus spears are tapered and thus bottom panel 16 has a larger cross sectional area than the top portion of the receptacle. To facilitate such loading, the receptacle may be placed on a rack to have the front portion of the receptacle, adjacent to front panel 30, maintained at a higher elevation than the rear portion thereof.

Referring to FIG. 4, upon loading of the asparagus spears in the receptacle, front panel 30 will be pivoted upwardly to engage lock flap 32, for example, between the slit defined between superimposed end panels 17 and 26. Flap portion 36 will snap into engagement beneath an exposed locking edge 38, defined on end panel 17 by cut 21. Lock tab 23, due to its inherent resiliency, will urge flap portion 36 into underlying relationship relative to edge 38 to maintain front panel 30 in its locked and closed position on the receptacle. It should be understood that only one lock means comprising lock flaps 32 or 33 and slit 21 need be utilized to maintain the front panel in its closed position, although it is preferable to employ both lock flaps.

Cover 11 may then be telescopically disposed on the receptacle for shipping purposes. In addition to facilitating loading, the stacked trapezoidal-shaped containers further provide substantial air channels therebetween for facilitating circulation of fresh air therethrough.

I claim:

1. A container comprising an opened top receptacle adapted to retain foodstuffs or the like therein and a separate cover telescopically disposed on said receptacle, said receptacle comprising a bottom panel, a pair of laterally spaced end panels, a back panel fixedly secured to each of said bottom and end panels and a front panel hingedly mounted on said container for pivotal movement between closed and opened positions, and lock means normally locking said front panel to at least one of said end panels when said front panel is maintained in its closed position on said container, each of said end panels comprising a pair of superimposed first and second end panels and means securing each pair of said first and second end panels together, a slit defined by said pair of end panels and terminating at forward edges thereof and wherein said lock means comprises at least one lock flap connected to said front panel and disposed in interlocking relationship within said slit when said front panel is maintained in its closed position, said lock means including means for retaining said lock flap in said interlocking relationship.

2. The container of claim 1 wherein said receptacle constitutes a one-piece paperboard blank.

3. The container of claim 1 wherein said front panel is hingedly connected to a forward edge of said bottom panel by a scoreline for permitting pivoting of said front panel between its closed and opened positions.

4. The container of claim 1 further comprising means forming a plurality of slots through panels of said receptacle and said cover, slots of said receptacle disposed in alignment with respect to slots formed through said cover to provide carrying means.

5. The container of claim 1 wherein said container has a trapezoidal cross section to adapt it for containment of tapered foodstuffs therein.

6. The container of claim 1 wherein said lock means further comprises a cut formed through the first end panel of said one pair of said first and second end panels, said cut terminating at a forward edge of such first end panel and defining a flexible lock tab thereon superimposed over said lock flap.

7. The container of claim 6 wherein a said cut is formed in each first end panel of each pair of first and second end panels whereby each of said first end panels define a said lock tab thereon and wherein a said lock flap is connected to each lateral edge of said front panel.

8. The container of claim 6 wherein said cut further defines an exposed locking edge on said one first end panel and wherein said lock flap defines a flap portion thereon engaged beneath said edge.

9. The container of claim 8 wherein said locking edge and said flap portion are generally trapezoidal-shaped.

* * * * *